US007910534B2

(12) United States Patent
Muller et al.

(10) Patent No.: US 7,910,534 B2
(45) **Date of Patent: *Mar. 22, 2011**

(54) SOLID LAUNDRY DETERGENT COMPOSITION COMPRISING ALKYL BENZENE SULPHONATE AND A HYDRATABLE MATERIAL

(75) Inventors: John Peter Eric Muller, Newcastle-upon-Tyne (GB); Lourdes Marina Ramirez Hernandez, Newcastle-upon-Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 535 days.

This patent is subject to a terminal disclaimer.

(21) Appl. No.: 11/505,005

(22) Filed: Aug. 16, 2006

(65) Prior Publication Data

US 2007/0042927 A1 Feb. 22, 2007

(30) Foreign Application Priority Data

Aug. 19, 2005 (EP) ..... 05018031

(51) Int. Cl.
*C11D 17/06* (2006.01)
*C11D 3/04* (2006.01)
*C11D 3/60* (2006.01)

(52) U.S. Cl. ..... 510/276; 510/351; 510/352; 510/357; 510/438; 510/443; 510/444; 510/452; 510/509

(58) Field of Classification Search ..... 510/276, 510/351, 352, 357, 509, 438, 443, 444, 452
See application file for complete search history.

(56) References Cited

U.S. PATENT DOCUMENTS

| | | | | |
|---|---|---|---|---|
| 3,629,951 | A | 12/1971 | Davis et al. | |
| 3,629,955 | A | 12/1971 | Davis et al. | |
| 3,703,772 | A | 11/1972 | McHugh et al. | |
| 4,687,592 | A | 8/1987 | Collins et al. | |
| 5,486,303 | A * | 1/1996 | Capeci et al. | 510/444 |
| 5,496,487 | A | 3/1996 | Capeci et al. | |
| 5,540,866 | A * | 7/1996 | Aszman et al. | 510/220 |
| 5,552,078 | A | 9/1996 | Carr et al. | |
| 5,712,242 | A | 1/1998 | Aouad et al. | |
| 5,756,444 | A | 5/1998 | Walters et al. | |
| 5,962,389 | A | 10/1999 | Partee et al. | |
| 6,274,545 | B1 | 8/2001 | Mazzola et al. | |
| 6,288,016 | B1 | 9/2001 | Ramanan et al. | |
| 6,509,310 | B1 | 1/2003 | Danton et al. | |
| 6,610,645 | B2 * | 8/2003 | Pancheri et al. | 510/509 |
| 6,630,439 | B1 * | 10/2003 | Norwood et al. | 510/445 |
| 6,635,610 | B1 * | 10/2003 | Tatsuno et al. | 510/276 |
| 6,673,766 | B1 * | 1/2004 | Hartshorn et al. | 510/446 |
| 7,078,373 | B2 * | 7/2006 | Burrows et al. | 510/351 |
| 2002/0028755 | A1 | 3/2002 | VanDijk et al. | |
| 2003/0158069 | A1 | 8/2003 | Horne et al. | |
| 2004/0097394 | A1 | 5/2004 | Burrows et al. | |
| 2005/0187127 | A1 * | 8/2005 | Somerville Roberts et al. | 510/336 |
| 2005/0187130 | A1 * | 8/2005 | Brooker et al. | 510/445 |
| 2006/0035802 | A1 * | 2/2006 | Brooker et al. | 510/445 |
| 2006/0035803 | A1 * | 2/2006 | Mort et al. | 510/445 |
| 2007/0037726 | A1 * | 2/2007 | Brooker et al. | 510/476 |
| 2007/0042926 | A1 | 2/2007 | Roberts | |
| 2007/0042928 | A1 | 2/2007 | Appleby et al. | |
| 2007/0042931 | A1 | 2/2007 | Roberts et al. | |
| 2007/0042932 | A1 | 2/2007 | Appleby et al. | |

FOREIGN PATENT DOCUMENTS

| | | |
|---|---|---|
| EP | 0349199 | 1/1990 |
| WO | WO 97/43366 | 11/1997 |
| WO | WO 00/18859 | 4/2000 |
| WO | WO 00/18873 | 4/2000 |
| WO | WO 02/053691 | 7/2002 |
| WO | WO 2005/052105 A | 6/2005 |
| WO | WO 2005/083046 A | 9/2005 |
| WO | WO 2005/083049 A | 9/2005 |

OTHER PUBLICATIONS

U.S. Appl. No. 11/504,918, filed Aug. 15, 2006, Roberts et al.

* cited by examiner

*Primary Examiner* — Lorna M Douyon

(57) ABSTRACT

The present invention relates to a solid laundry detergent composition in particulate form comprising a plurality of particulate components, the composition comprises: (i) an alkyl benzene sulphonate; (ii) a hydratable material; (iii) from 0% to less than 5%, by weight of the composition, of zeolite builder; (iv) from 0% to less than 5%, by weight of the composition, of phosphate builder; and (v) optionally, from 0% to less than 5%, by weight of the composition, of silicate salt; wherein at least 30%, by weight of the composition, of the particulate components present in the composition comprise at least 15%, by weight of the particulate component, of the hydratable material, and wherein any particulate component comprising at least 5%, by weight of the particulate component, of alkyl benzene sulphonate also comprises at least 15%, by weight of the particulate component, of the hydratable material.

5 Claims, No Drawings

SOLID LAUNDRY DETERGENT COMPOSITION COMPRISING ALKYL BENZENE SULPHONATE AND A HYDRATABLE MATERIAL

FIELD OF THE INVENTION

The present invention relates to under-built highly soluble granular laundry detergent compositions comprising alkyl benzene sulphonate and a hydratable material. The compositions of the present invention have a good cleaning performance, good dispensing and dissolution profiles and good physical characteristics.

BACKGROUND OF THE INVENTION

There have been relatively recent attempts by many detergent manufacturers to significantly improve the dissolution and dispensing performance of their granular laundry detergents. The approach many detergent manufacturers have focused on is the significant reduction in the level of, or even the complete removal of, water-insoluble builder, such as zeolite builder, in/from their granular laundry detergent formulations. However, due to the phosphate-usage avoidance legislation in many countries which prevents the detergent manufacturers from incorporating a sufficient amount of phosphate-based water-soluble builders, such as sodium tripolyphosphate, in their granular laundry detergents, and due to the lack of feasible alternative non-phosphate based water-soluble builders available to the detergent manufacturers, the approach many detergent manufacturers have focused on is to not completely replace the zeolite-based builder system with a water-soluble builder system having an equivalent degree of builder capability, but instead to formulate an under-built granular laundry detergent composition.

Whilst this under-built approach does significantly improve the dissolution and dispensing performance of the granular laundry detergent, problems do exist due to the significant amount of cations, such as calcium, that are not removed from the wash liquor by the builder-system of the granular laundry detergent composition during the laundering process. These cations interfere with the anionic detersive surfactant system of the granular laundry detergent composition in such a manner as to cause the anionic detersive surfactant to precipitate out of solution, which leads to a reduction in the anionic detersive surfactant activity and cleaning performance. In extreme cases, these water-insoluble complexes may deposit onto the fabric resulting in poor whiteness maintenance and poor fabric integrity benefits. This is especially problematic when the laundry detergent is used in hard-water washing conditions when there is a high concentration of calcium cations.

Another problem that needs to be overcome when the level of water-insoluble builders such as zeolite are significantly reduced in the composition, or when the zeolite is completely removed from the formulation, is the poor physical characteristics of the composition, especially after storage, which result in a poor cake strength.

The Inventors have found that the cleaning performance and physical characteristics of under-built detergent compositions is improved by carefully controlling where and how much hydratable material is incorporated into the under-built detergent composition in relation to alkyl benzene sulphonate.

U.S. Pat. No. 5,552,078 by Carr et al, Church & Dwight Co. Inc., relates to a powdered laundry detergent composition comprising an active surfactant, at least 70 wt % of a water-soluble alkaline carbonate salt, e.g. sodium carbonate, from 0.1 wt % to 2 wt % of a phosphate-builder, e.g. sodium tripolyphosphate, from 0.1 wt % to 2 wt % of a carboxylate polymer, and from 1 wt % to 12 wt % of water. It is alleged that compositions of U.S. Pat. No. 5,552,078 exhibit excellent cleaning and whitening of fabrics whilst avoiding the problem of eutrophication which occurs when a substantial amount of phosphate-builder is present in the composition, and while minimizing the problem of fabric-encrustation often present when the composition contains a large amount of carbonate builder. However, no details are given by U.S. Pat. No. 5,552,078 about the make-up of individual particles within the composition, and none of the detergent compositions exemplified by U.S. Pat. No. 5,552,078 comprise a hydratable material and alkyl benzene sulphonate.

U.S. Pat. No. 6,274,545 B1 by Mazzola, Church & Dwight Co. Inc., relates to a high-carbonate low-phosphate powder laundry detergent formulation which can allegedly be utilized in cold water fabric laundering with a minimized remainder of undissolved detergent residue in the wash liquor. The detergent composition of U.S. Pat. No. 6,274,545 B1 comprises an anionic/nonionic surfactant blend that is a partially sulphated and neutralized ethoxylated alcohol surfactant, and a polyethylene glycol ingredient, which allegedly increases the solubility of the laundry detergent solids in the wash liquor. However, U.S. Pat. No. 6,274,545 B1 does not give any details about how ingredients such as alkyl benzene sulphonate are incorporated into the composition in relation to any hydratable material, and none of the detergent compositions exemplified by U.S. Pat. No. 6,274,545 B1 comprise a hydratable material and alkyl benzene sulphonate.

WO97/43366 by Askew et al, The Procter & Gamble Company, relates to a detergent composition that comprises an effervescence system. WO97/43366 exemplifies a carbonate built bleach-free detergent composition. However, WO97/43366 does not give any details about how ingredients such as surfactant and hydratable material are incorporated into the composition.

WO00/18873 by Hartshorn et al, The Procter & Gamble Company, relates to detergent compositions having allegedly good dispensing performance and allegedly do not leave residues on the fabric after the laundering process.

WO00/18859 by Hartshorn et al, The Procter & Gamble Company, relates to detergent compositions allegedly having an improved delivery of ingredients into the wash liquor during the laundering process. The compositions of WO00/18859 allegedly do not as readily gel upon contact with water and allegedly do not leave water-insoluble residues on clothes after the laundering process. The compositions of WO00/18859 comprise a predominantly water-soluble builder system that is intimately mixed with a surfactant system.

WO02/053691 by Van der Hoeven et al, Hindustain Lever Limited, relates to a laundry detergent composition comprising greater than 10 wt % of a calcium tolerant surfactant, from 0.1 wt % to 10 wt % of a strong builder system selected from phosphate builders and/or zeolite builders, and less than 35 wt % of non-functional non-alkaline water-soluble inorganic salts. However, WO02/053691 does not give any details about how ingredients such as surfactant and hydratable material are incorporated into the composition.

SUMMARY OF THE INVENTION

The present invention provides a solid laundry detergent composition in particulate form comprising a plurality of particulate components, the composition comprises: (i) alkyl benzene sulphonate; (ii) a hydratable material; (iii) from 0% to less than 5%, by weight of the composition, of zeolite builder; (iv) from 0% to less than 5%, by weight of the composition, of phosphate builder; and (v) optionally, from 0% to less than 5%, by weight of the composition, of silicate salt; wherein preferably at least 30%, by weight of the composition, of the particulate components present in the composition comprise at least 15%, by weight of the particulate component, of the hydratable material, and wherein preferably any particulate component comprising at least 5%, by weight of the particulate component, of alkyl benzene sulphonate also comprises at least 15%, by weight of the particulate component, of the hydratable material.

DETAILED DESCRIPTION OF THE INVENTION

Solid Laundry Detergent Composition

The composition comprises alkyl benzene sulphonate, a hydratable material, from 0% to less than 5%, by weight of the composition, of zeolite builder; from 0% to less than 5%, by weight of the composition, of phosphate builder; and optionally, from 0% to less than 5%, by weight of the composition, of silicate salt. The composition may comprise other adjunct ingredients.

The composition is in particulate form, such as an agglomerate, a spray-dried power, an extrudate, a flake, a needle, a noodle, a bead, or any combination thereof. The composition may be in compacted-particulate form, such as in the form of a tablet. The composition may be in some other unit dose form, such as being in the form of a pouch; typically being at least partially, preferably essentially completely, enclosed by a water-soluble film such as polyvinyl alcohol. Preferably the composition is in free-flowing particulate form; by free-flowing particulate form, it is typically meant that the composition is in the form of separate discrete particles. The composition may be made by any suitable method including agglomeration, spray-drying, extrusion, mixing, dry-mixing, liquid spray-on, roller compaction, spheronisation, tabletting or any combination thereof.

The composition typically has a bulk density of from 450 g/l to 1,000 g/l, preferred low bulk density detergent compositions have a bulk density of from 550 g/l to 650 g/l and preferred high bulk density detergent compositions have a bulk density of from 750 g/l to 900 g/l. During the laundering process, the composition is typically contacted with water to give a wash liquor having a pH of from above 7 to less than 13, preferably from above 7 to less than 10.5. This is the optimal pH to provide good cleaning whilst also ensuring a good fabric care profile.

The composition comprises a plurality of particulate components. In preferred embodiments, least 30%, by weight of the composition, of the particulate components present in the composition comprise at least 15%, by weight of the particulate component, of a hydratable material. Preferably at least 35%, or at least 40%, or at least 45%, or at least 50%, or at least 55%, or at least 60%, or even at least 65%, by weight of the composition, of particulate components present in the composition comprise at least 17%, or at least 20%, or at least 22%, or at least 25%, by weight of the particulate component, of the hydratable material. These levels and incorporation profile of hydratable material in the composition ensures that the composition has a good cleaning performance and good physical characteristics such as good cake strength, especially after storage.

In preferred embodiments, any particulate component that comprises at least 5%, or preferably at least 10%, or even at least 15%, by weight of the particulate component, of alkyl benzene sulphonate, also comprises at least 10%, or at least 15%, or at least 20%, or even at least 25%, by weight of the particulate component, of the hydratable material. These levels and incorporation profile of hydratable material in the composition ensure that the composition has a good cleaning performance and good physical characteristics such as good cake strength, especially after storage.

The composition typically has an equilibrium relative humidity of from 0% to less than 30%, preferably from 0% to 20%, when measured at a temperature of 35° C. Typically, the equilibrium relative humidity is determined as follows: 300 g of composition is placed in a 1 litre container made of a water-impermeable material and fitted with a lid capable of sealing the container. The lid is provided with a sealable hole adapted to allow insertion of a probe into the interior of the container. The container and its contents are maintained at a temperature of 35° C. for 24 hours to allow temperature equilibration. A solid state hygrometer (Hygrotest 6100 sold by Testoterm Ltd, Hapshire, UK) is used to measure the water vapour pressure. This is done by inserting the probe into the interior of the container via the sealable hole in the container's lid and measuring the water vapour pressure of the head space. These measurements are made at 10 minute intervals until the water vapour pressure has equilibrated. The probe then automatically converts the water vapour pressure reading into an equilibrium relative humidity value.

Preferably, the composition upon contact with water at a concentration of 9.2 g/l and at a temperature of 20° C. forms a transparent wash liquor having (i) a turbidity of less than 500 nephelometric turbidity units; and (ii) a pH in the range of from 8 to 12. Preferably, the resultant wash liquor has a turbidity of less than 400, or less than 300, or from 10 to 300 nephelometric turbidity units. The turbidity of the wash liquor is typically measured using a H1 93703 microprocessor turbidity meter. A typical method for measuring the turbidity of the wash liquor is as follows: 9.2 g of composition is added to 1 litre of water in a beaker to form a solution. The solution is stirred for 5 minutes at 600 rpm at 20° C. The turbidity of the solution is then measured using a H1 93703 microprocessor turbidity meter following the manufacturer's instructions.

Alkyl Benezene Sulphonate

The composition comprises alkyl benzene sulphonate. Preferably the alkyl benzene sulphonate is a linear or branched, substituted or unsubstituted, $C_{8-24}$ alkyl benzene sulphonate. Preferably the composition comprises from 0.1%, or from 1%, or from 2.5%, or from 5%, or from 7.5%, or from 10%, and to 50%, or to 40%, or to 30%, or to 20%, by weight of the composition, of alkyl benzene sulphonate. This is the optimal level of the alkyl benzene sulphonate to provide a good cleaning performance. The alkyl benzene sulphonate can be a modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548. Highly preferred alkyl benzene sulphonates are linear $C_{10-13}$ alkylbenzene sulphonates. Especially preferred are linear $C_{10-13}$ alkylbenzene sulphonates that are obtainable, preferably obtained, by sulphonating commercially available linear alkyl benzenes (LAB); suitable LABs include low 2-phenyl LAB, such as those supplied by Sasol under the tradename Isochem® or those supplied by Petresa under the tradename Petrelab®, other suitable LABs include high 2-phenyl LAB, such as those supplied by Sasol under the tradename Hyblene®.

The alkyl benzene sulphonate is typically in particulate form, such as an agglomerate, a spray-dried powder, an extrudate, a bead, a noodle, a needle or a flake. It may be preferred for part of the alkyl benzene sulphonate to be in the form of a spray-dried powder (e.g. a blown powder), and for part of the $C_{8-24}$ alkyl benzene sulphonate to be in the form of a non-spray-dried powder (e.g. an agglomerate, or an extrudate, or a flake such as a linear alkyl benzene sulphonate flake; suitable linear alkyl benzene sulphonate flakes are supplied by Pilot Chemical under the tradename F90®, or by Stepan under the tradename Nacconol 90G®). This is especially preferred when it is desirable to incorporate high levels of alkyl benzene sulphonate in the composition.

Hydratable Material

The composition comprises a hydratable material. Preferably the composition comprises at least 10%, or at least 20%, or at least 30%, and to less than 70%, or even to less than 60%, by weight of the composition, of a hydratable material.

The hydratate material typically has a hydration index of greater than 1.00, preferably greater then 1.01, or greater than 1.02, or greater than 1.03, or greater than 1.04, or greater than 1.05, or greater than 1.06, or greater than 1.07, or greater than 1.08, or greater than 1.09, or greater than 1.10, or greater than 1.11, or greater than 1.12, or greater than 1.13, or greater than 1.14, or greater than 1.15.

The hydration index is typically determined by the following protocol: (i) 100 g of the hydratable material in anhydrous form is spread evenly on a 20 cm by 30 cm rectangular tray and placed in a constant humidity chamber at 80% relative humidity and 25° C. until the hydratable material reaches equilibrium mass. (ii) The hydratable material is then placed in a constant humidity chamber at 30% relative humidity and 25° C. until the hydratable material reaches equilibrium mass. (iii) The weight of the hydratable material is then recorded. The hydration index is typically calculated by: the weight in grams of the hydratable material calculated in step (iii)/100 g.

Preferably, the hydratable material is a salt, such as a sodium carbonate salt and/or magnesium sulphate. Typically, the hydratable material is not sodium sulphate.

Zeolite Builder

The composition comprises from 0% to less than 5%, or to 4%, or to 3%, or to 2%, or to 1%, by weight of the composition, of zeolite builder. It may even be preferred for the composition to be essentially free from zeolite builder. By essentially free from zeolite builder it is typically meant that the composition comprises no deliberately added zeolite builder. This is especially preferred if it is desirable for the composition to be very highly soluble, to minimise the amount of water-insoluble residues (for example, which may deposit on fabric surfaces), and also when it is highly desirable to have transparent wash liquor. Zeolite builders include zeolite A, zeolite X, zeolite P and zeolite MAP.

Phosphate Builder

The composition comprises from 0% to less than 5%, or to 4%, or to 3%, or to 2%, or to 1%, by weight of the composition, of phosphate builder. It may even be preferred for the composition to be essentially free from phosphate builder. By essentially free from phosphate builder it is typically meant that the composition comprises no deliberately added phosphate builder. This is especially preferred if it is desirable for the composition to have a very good environmental profile. Phosphate builders include sodium tripolyphosphate.

Silicate Salt

The composition optionally comprises from 0% to less than 5%, or to 4%, or to 3%, or to 2%, or to 1%, by weight of the composition, of a silicate salt. Whilst the composition may comprise levels of silicate salt of 5 wt % or greater, preferably the composition comprises less than 5 wt % silicate salt. It may even be preferred for the composition to be essentially free from silicate salt. By essentially free from silicate salt it is typically meant that the composition comprises no deliberately added silicate. This is especially preferred in order to ensure that the composition has a very good dispensing and dissolution profiles and to ensure that the composition provides a clear wash liquor upon dissolution in water. Silicate salts include water-insoluble silicates. Silicate salts include amorphous silicates and crystalline layered silicates (e.g. SKS-6). A preferred silicate salt is sodium silicate.

Adjunct Ingredients

The composition typically comprises adjunct ingredients. These adjunct ingredients include: detersive surfactants such as, nonionic detersive surfactants, cationic detersive surfactants, zwitterionic detersive surfactants, amphoteric detersive surfactants; preferred anionic detersive surfactants are alkoxylated anionic detersive surfactants such as linear or branched, substituted or unsubstituted $C_{12-18}$ alkyl alkoxylated sulphate having an average degree of alkoxylation of from 1 to 30, preferably from 1 to 10, more preferably a linear or branched, substituted or unsubstituted $C_{12-18}$ alkyl ethoxylated sulphate having an average degree of ethoxylation of from 1 to 10, most preferably a linear unsubstituted $C_{12-18}$ alkyl ethoxylated sulphate having an average degree of ethoxylation of from 3 to 7, other preferred anionic detersive surfactants are alkyl sulphates, alkyl sulphonates, alkyl phosphates, alkyl phosphonates, alkyl carboxylates or any mixture thereof; preferred nonionic detersive surfactants are $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10; preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures thereof, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; enzymes such as amylases, carbohydrases, cellulases, laccases, lipases, oxidases, peroxidases, proteases, pectate lyases and mannanases; suds suppressing systems such as silicone based suds suppressors; fluorescent whitening agents; photobleach; filler salts such as sulphate salts, preferably sodium sulphate; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as carboxymethyl cellulose and polyesters; perfumes; sulphamic acid or salts thereof; citric acid or salts thereof; dyes such as orange dye, blue dye, green dye, purple dye, pink dye, or any mixture thereof; carboxylate polymers such as co-polymers of maleic acid and acrylic acid.

Preferably, the composition comprises less than 1 wt % chlorine bleach and less than 1 wt % bromine bleach. Preferably, the composition is essentially free from bromine bleach and chlorine bleach. By "essentially free from" it is typically meant "comprises no deliberately added".

EXAMPLES

The following solid laundry detergent compositions are in accordance with the present invention:

| | A | B | C | D | E | F |
|---|---|---|---|---|---|---|
| Spray-dried particles | | | | | | |
| $C_{10-13}$ linear alkyl benzene sulfonate | 7.50 | 7.50 | 7.50 | 7.50 | 7.50 | 7.50 |
| $C_{12-16}$ alkyl ethoxylated sulphate having an average ethoxylation degree of 3 | | 1.00 | 1.00 | | | |
| Hydroxyethane di(methylene phosphonic acid) | 0.20 | 0.20 | 0.20 | 0.20 | 0.20 | 0.20 |
| Ethylenediamine disuccinic acid | 0.25 | 0.25 | 0.25 | 0.25 | 0.25 | 0.25 |
| Acrylate/maleate copolymer | 3.15 | 3.15 | 3.15 | 3.15 | 3.15 | 3.15 |
| Sodium carbonate | 16.50 | 18.00 | 18.00 | 16.50 | 16.50 | 16.50 |
| Fluorescent-whitening agent | 0.15 | 0.15 | 0.15 | 0.15 | 0.15 | 0.15 |
| Magnesium sulphate | 0.45 | 0.45 | 0.45 | 0.45 | 0.45 | 0.45 |
| Sodium sulphate | 21.50 | 21.50 | 21.50 | 21.50 | 21.50 | 21.50 |
| Miscellaneous and water | 4.00 | 4.00 | 4.00 | 4.00 | 4.00 | 4.00 |
| Total spray-dried particles | 53.70 | 56.20 | 56.20 | 53.70 | 53.70 | 53.70 |
| Surfactant agglomerate | | | | | | |
| $C_{12-16}$ alkyl ethoxylated sulphate having an average ethoxylation degree of 3 | 6.00 | 6.00 | | 6.00 | 6.00 | 5.00 |
| $C_{10-13}$ linear alkyl benzene sulfonate | | | 4.00 | | | 1.00 |
| Sodium carbonate | 17.00 | 17.00 | 19.00 | 17.00 | 17.00 | 17.00 |
| Miscellaneous and water | 1.00 | 1.00 | 1.00 | 1.00 | 1.00 | 1.00 |
| Total surfactant agglomerate | 24.00 | 24.00 | 24.00 | 24.00 | 24.00 | 24.00 |
| Dry-added ingredients | | | | | | |
| Sodium percarbonate having an AvOx of 14 wt % | 11.00 | 10.00 | 10.00 | | | 11.00 |
| Sodium sulphate | | | | 14.00 | 14.50 | |
| Enzymes | 0.50 | 0.50 | 0.50 | 0.50 | | 0.50 |
| Tetraacetylethylenediamine | 3.00 | 2.50 | 2.50 | | | 3.00 |
| Citric acid | 3.00 | 2.00 | 2.00 | 3.00 | 3.00 | 3.00 |
| Suds suppressor | 0.80 | 0.80 | 0.80 | 0.80 | 0.80 | 0.80 |
| Miscellaneous and water | to 100% | to 100% | to 100% | to 100% | to 100% | to 100% |

The invention claimed is:

1. a solid laundry detergent composition in particulate form comprising a plurality of particulate components, the composition comprises:

(i)alkyl benzene sulphonate;

(ii) a hydratable material;

(iii) free of zeolite and phosphate builder; and (iv) essentially free of silicate salt;

wherein at least 30%, by weight of the composition, of the particulate components present in the composition comprise at least 15%, by weight of the particulate component, of a hydratable material, and wherein any particulate component comprising at least 5%, by weight of the particulate component, of alkyl benzene sulphonate also consists essentially of at least 15%, by weight of the particulate component, of the hydratable material, wherein in said composition said hydratable material is magnesium sulfate and is not sodium sulfate; and wherein said composition comprises a mixture of three of said particulate components:

(a) a spray-dried component comprising said alkyl benzene sulphonate and said hydratable magnesium sulfate;

(b) an agglomerate component comprising said alkyl benzene sulphonate and said hydratable magnesium sulfate; and (c) a dry-added component;

said composition having a density in the range of 450-550 g/l.

2. A composition according to claim 1, wherein at least 60%, by weight of the composition, of the particulate components that are present in the composition comprise at least 20%, by weight of the particulate component, of the hydratable material.

3. A composition according to claim 1, wherein any particulate component that comprises at least 5%, by weight of the particulate component, of alkyl benzene sulphonate, also comprises at least 20%, by weight of the particulate component, of the hydratable material.

4. A composition according to claim 1, wherein the composition comprises a linear or branched, substituted or unsubstituted, C8-18 alkyl alkoxylated sulphate having an average degree of alkoxylation of from 1 to 20.

5. A composition according to claim 1, wherein the composition comprises from 1% to less than 70%, by weight of the composition, of the hydratable material.

* * * * *